US011208802B2

(12) United States Patent
Raffion

(10) Patent No.: US 11,208,802 B2
(45) Date of Patent: Dec. 28, 2021

(54) CONSTRUCTION BLOCK WITH INSULATION

(71) Applicant: Haïdar Ben Raffion, Quimper (FR)

(72) Inventor: Haïdar Ben Raffion, Quimper (FR)

( * ) Notice: Subject to any disclaimer, the term of this patent is extended or adjusted under 35 U.S.C. 154(b) by 19 days.

(21) Appl. No.: 16/955,633

(22) PCT Filed: Dec. 20, 2018

(86) PCT No.: PCT/FR2018/053432
§ 371 (c)(1),
(2) Date: Jun. 18, 2020

(87) PCT Pub. No.: WO2019/122730
PCT Pub. Date: Jun. 27, 2019

(65) Prior Publication Data

US 2020/0385984 A1 Dec. 10, 2020

(30) Foreign Application Priority Data

Dec. 20, 2017 (FR) ..... 17 62649

(51) Int. Cl.
*E04B 2/18* (2006.01)
*E04C 1/41* (2006.01)
(Continued)

(52) U.S. Cl.
CPC ..... *E04B 2/18* (2013.01); *E04C 1/41* (2013.01); *E04B 2/42* (2013.01); *E04B 2002/0206* (2013.01); *E04B 2002/0226* (2013.01)

(58) Field of Classification Search
CPC ..... E04B 2/18; E04B 2/42; E04B 2002/0206; E04B 2002/0226; E04C 1/41; E04C 1/40
See application file for complete search history.

(56) References Cited

U.S. PATENT DOCUMENTS 3,290,849 A * 12/1966 Wright ..... E04B 2/14 52/541
4,315,391 A * 2/1982 Piazza ..... E04B 2/84 52/293.2
(Continued)

FOREIGN PATENT DOCUMENTS

DE 4402135 A1 7/1995
EP 0726369 A1 8/1996
(Continued)

*Primary Examiner* — Rodney Mintz
(74) *Attorney, Agent, or Firm* — Im IP Law; Chai Im; C. Andrew Im

(57) ABSTRACT

A substantially parallelepipedal construction block includes an upper face configured to be associated with the lower face(s) of one or two other similar construction block(s), a lower face configured to be associated with the upper face(s) of one or two similar construction block(s) and at least two vertical openings. The construction block also includes a front face, a rear face and two lateral faces with a recess which allows two beads to appear at the sides of the two lateral faces. The construction block is constituted by expanding foam and sand, and an insulation portion situated between the rear face and the front face. The insulation portion extends over the width of the construction block and is substantially parallelepipedal. The height and the length of the insulation portion is identical to the construction block.

4 Claims, 4 Drawing Sheets

(51) Int. Cl.
*E04B 2/42* (2006.01)
*E04B 2/02* (2006.01)

(56) References Cited

U.S. PATENT DOCUMENTS 4,641,470 A * 2/1987 Baumberger ..... E04C 1/41 52/309.17
4,854,097 A * 8/1989 Haener ..... E04C 1/41 52/309.11
5,024,035 A * 6/1991 Hanson ..... E04B 2/18 52/309.12
5,465,544 A * 11/1995 Ghahary ..... B32B 21/08 52/311.1
5,775,047 A 7/1998 Jensen
5,960,604 A * 10/1999 Blanton ..... E04B 2/18 52/590.2
7,984,594 B1 * 7/2011 Propst ..... B32B 3/18 52/309.12
8,549,808 B2 * 10/2013 Badin ..... B28B 23/0056 52/405.4
9,482,003 B2 * 11/2016 Browning ..... E04C 1/397
10,487,504 B1 * 11/2019 Nickerson ..... E04C 1/41
10,544,587 B2 * 1/2020 Ibrahim ..... C04B 16/08
10,563,397 B2 * 2/2020 Van Cauter ..... E04B 2/26
11,028,598 B2 * 6/2021 Browning ..... E04F 13/0885
11,091,911 B1 * 8/2021 Schnabel ..... E04B 1/7604
2008/0104916 A1 * 5/2008 Schmid ..... B28B 11/042 52/405.2
2008/0184650 A1 * 8/2008 Fischer ..... E04B 2/8629 52/606
2009/0173027 A1 * 7/2009 Bennett ..... E04C 1/40 52/309.17
2009/0288361 A1 * 11/2009 Badin ..... B29C 39/10 52/589.1
2011/0173911 A1 * 7/2011 Propst ..... B32B 5/26 52/309.13
2011/0239570 A1 * 10/2011 Bennett ..... E04B 2/16 52/309.17
2014/0196397 A1 * 7/2014 Sourlis ..... E04C 1/39 52/503
2014/0260029 A1 * 9/2014 Browning ..... E04B 2/14 52/309.4
2018/0179762 A1 * 6/2018 Browning ..... C04B 18/027
2018/0298608 A1 * 10/2018 Van Cauter ..... E04B 2/26
2019/0284804 A1 * 9/2019 Ibrahim ..... B32B 5/18
2019/0338514 A1 * 11/2019 Daysh ..... E04B 2/44
2021/0156147 A1 * 5/2021 Fermanian ..... E04B 2/26

FOREIGN PATENT DOCUMENTS

FR 3032735 A1 8/2016
WO 9209762 A1 6/1992
WO 2007128082 A1 11/2007

* cited by examiner

CONSTRUCTION BLOCK WITH INSULATION

RELATED APPLICATIONS

This application is a § 371 application of PCT/FR2018/053432 filed Dec. 20, 2018, which claims priority from French Patent Application No. 17 62649 filed Dec. 20, 2017, each of which is incorporated herein by reference in its entirety.

TECHNICAL FIELD OF THE INVENTION

The present invention relates to the field of construction, more particularly the construction of houses or buildings from construction blocks. More particularly, the invention relates to the construction of a wall or similar from construction blocks that can be superimposed. The invention relates to the construction of the wall or similar type, extending at least over a horizontal direction and a vertical direction. This construction includes a plurality of rows of superimposed construction blocks, and a construction block of substantially parallelepiped shape. Each construction block comprising an upper face at least able to be associated with the lower face or faces of one or two other similar construction blocks, a lower face at least able to be associated with the upper face or faces of one or two other similar construction blocks.

BACKGROUND OF THE INVENTION

Building blocks made of concrete or mortar are very commonly used for carrying out construction works.

Many problems then arise regarding these building blocks, which must be both easy to manipulate for the construction and have interesting characteristics in particular in terms of thermal and acoustic insulation.

OBJECT OF THE INVENTION

The present invention aims to overcome these disadvantages.

To this effect, the present invention relates to a construction block of substantially parallelepiped shape and comprises an upper face at least able to be associated with the lower face or faces of one or two other similar construction blocks, a lower face at least able to be associated with the upper face or faces of one or two similar construction blocks, at least two vertical openings, the construction block comprises a front face, a rear face and two lateral faces with a recess which allows two beads to appear at the sides of the two lateral faces, said construction block is remarkable in that said construction block (20) being constituted by expanding foam and sand, between the rear face (23) and the front face (24) is an insulation portion (29) extending over the width of the construction block (20), said insulation portion (29) having a substantially parallelepiped shape and of which the height and the length is identical to the construction block (20).

Thanks to these arrangements, the construction block makes it possible to insulate and soundproof. It is also lighter, easier to transport and handle.

"Expanding foam" means a "single-component" polyurethane foam that swells while drying.

The liquid polyurethane is transformed into foam by a chemical reaction (called polymerisation) thanks to the humidity of the air or to an adding of water. It is generally packaged in a spray can, to be shaken before use. It can be used indoors and outdoors, adheres extremely well to most materials (concrete, brick, plastic, plaster, metals, etc.), has exceptional insulating qualities (1 centimetre of foam would be equal to 40 metres of concrete) and swells enormously (one can of 500 millilitres yields about 20 litres of foam).

The invention is advantageously implemented according to the embodiments and alternatives disclosed hereinafter, which are to be considered individually or according to any technically permissible combination.

In an embodiment, the quantity of expanding foam is comprised between 0.5% to 15% by weight in sand, preferably between 2% to 8%, preferably between 3% and 6%.

In an embodiment, the rear face includes at least one rectangular cladding, with a normally rectangular section.

In an embodiment, the front face includes at least one rectangular cladding, with a normally rectangular section.

In an embodiment, the rear face or the front face includes two rectangular claddings, with a normally rectangular section between which is a shadow gap.

BRIEF DESCRIPTION OF THE FIGURES

Other advantages, purposes and characteristics of the present invention will come from the following description given, for the purposes of explanation and in no way in a limiting manner, with regards to the accompany drawings, wherein.

DETAILED DESCRIPTION OF EMBODIMENTS OF THE INVENTION

Figure 1:
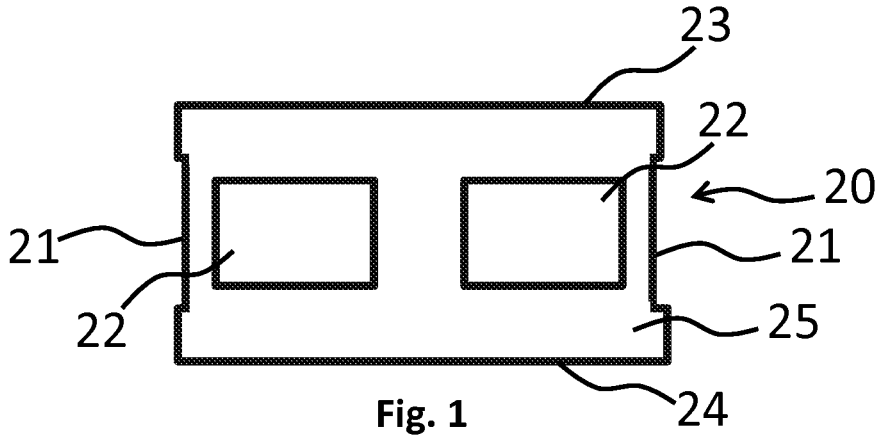
FIG. 1 shows a top view of a first example of a construction block according to the invention.

FIG. 1 shows a construction block 20 of substantially parallelepiped shape and comprises an upper face 25 at least able to be associated with the lower face or faces of one or two other similar construction blocks (not shown), a lower face (not shown) at least able to be associated with the upper face or faces of one or two similar construction blocks 20 (not shown), at least two vertical openings 22. The construction block 20 comprises two lateral faces with a recess 21 and a front face 24 and a rear face 23.

The construction block 20 comprises a quantity of expanding foam which is 4.6% by weight sand. According to an example, the quantity of expanding foam is 70 ml and the quantity of sand is 1.5 kg.

The percentage between 3 and 6% by weight in sand corresponds to the good compromise between the quantity of expanding foam and the good mechanical strength of the construction block 20.

Figure 2:
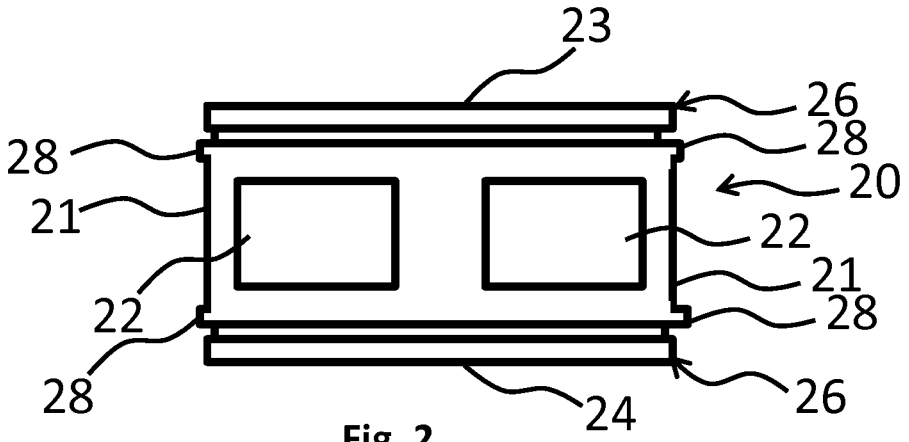
FIG. 2 shows a top view of another example of a construction block according to the invention.

FIG. 2 shows a top view of another example of a construction block 20. FIG. 2 includes certain elements of preceding figure.

The front face 24 includes a rectangular cladding 26, with a normally rectangular section.

There is a gap on the edge of the cladding 26. The gap extends entirely around the cladding 26 over the horizontal edge of the front face 24 and the vertical edge.

The construction block 20 includes two vertical openings 22.

The two vertical openings 22 are rectangular and disposed symmetrically on either side of the transverse median plane of the construction block 20.

On the two lateral faces, each recess 21 allows a vertical bead 28 in relief to appear intended respectively to bear against the vertical beads 28 of the adjacent construction blocks 20.

Figure 3:
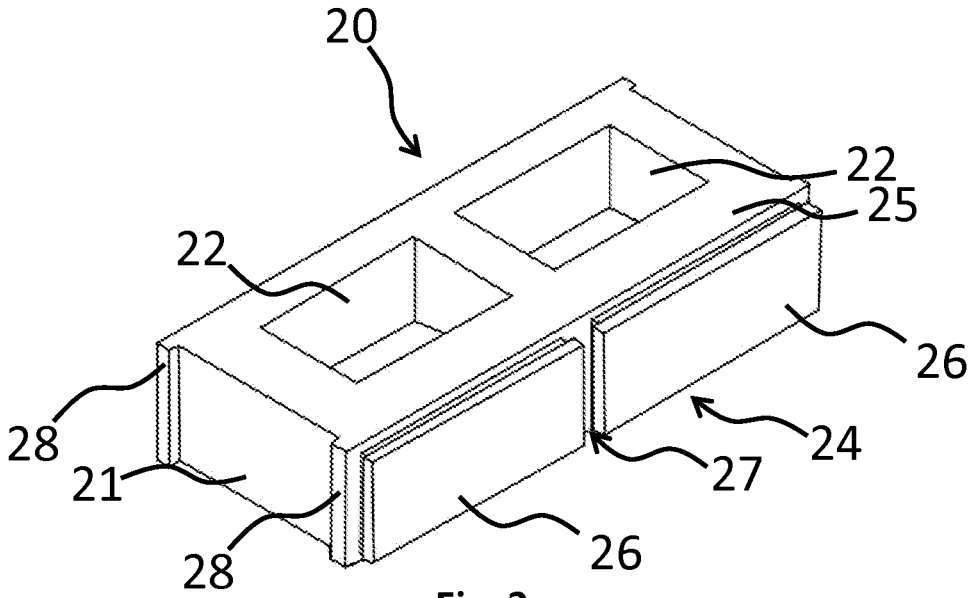
FIG. 3 shows a perspective view of another example of a construction block according to the invention.

FIG. 3 shows a perspective view of another example of a construction block 20. FIG. 3 includes certain elements of the preceding figure.

The construction block 20 includes two vertical openings 22.

The front face 24 includes two rectangular claddings 26, with a normally rectangular section. Between the two rectangular claddings 26 is a shadow gap 27. In other words, each cladding 26 is bordered on one of the vertical edges thereof by a shadow gap 27.

"Shadow gap" 27 means a groove in the material.

During the stacking of the construction blocks 20, each cladding 26 is always separated from one of the adjacent claddings 26 by a gap 27: either constituted between two claddings 26 of the same construction block 20, or constituted by a cladding 26 of a block and of another adjacent cladding 26 of another adjacent construction block 20.

The gaps play the role of shadow gaps carried out, in conventional assembly with mortar.

Figure 4:
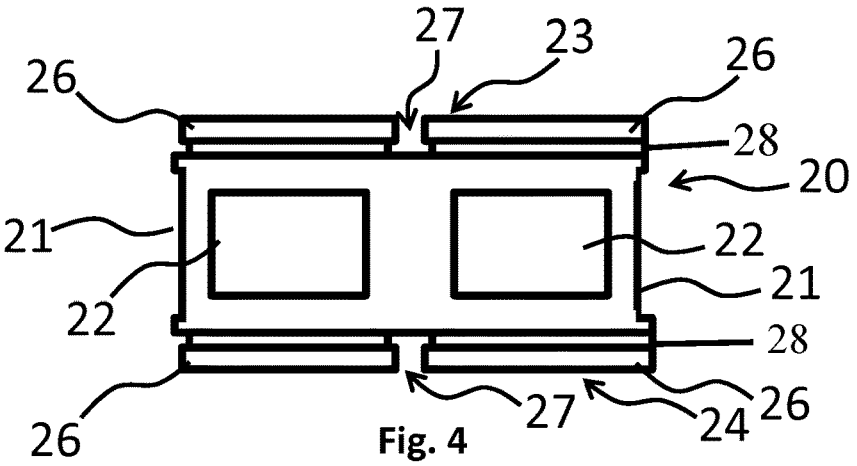
FIGS. 4 to 12 show as a top view other examples of a construction block according to the invention.

FIG. 4 shows a top view of another example of a construction block 20. This figure includes certain elements from the preceding figures.

In FIG. 4, the rear face 23 includes two rectangular claddings 26, with a normally rectangular section and the front face 24 includes two rectangular claddings 26, with a normally rectangular section.

In FIG. 4, one of the lateral faces includes two substantial beads 28 (the one on the right in the figure), i.e. it is wider than the other lateral face. The gap of the cladding 26 adjacent to said lateral face does not exist.

Figure 5:
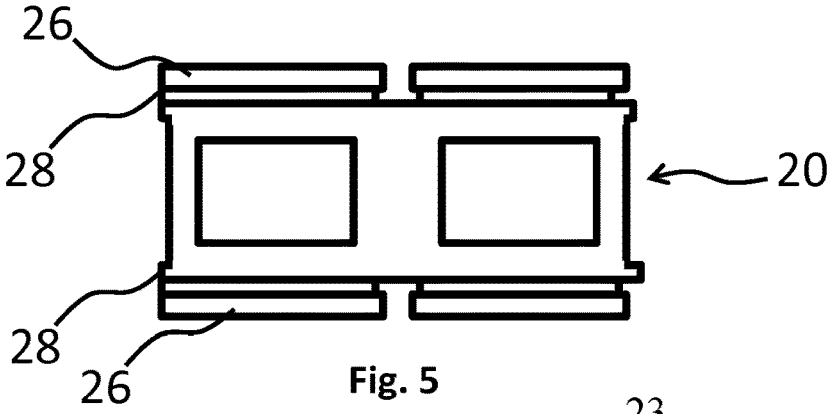

FIG. 5 shows a top view of another example of a construction block 20. FIG. 5 includes certain elements from the preceding figures.

In FIG. 5, one of the lateral faces includes two substantial beads 28 (the one on the left in the figure), i.e. it is wider than the other lateral face. The gap of the cladding 26 adjacent to said lateral face does not exist.

Figure 6:
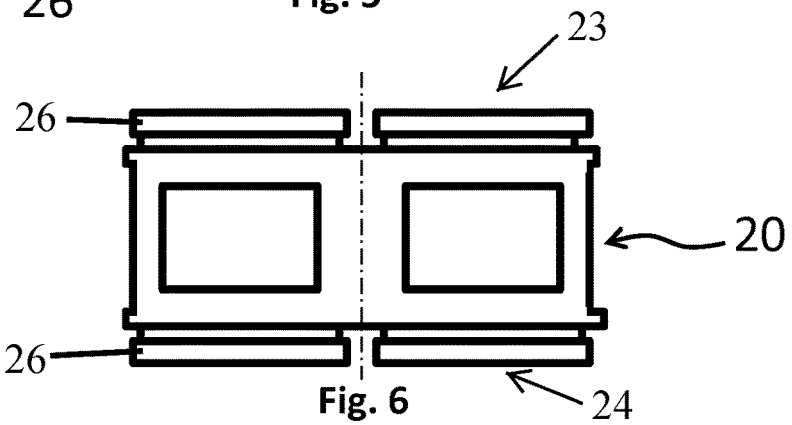

FIG. 6 shows a top view of another example of a construction block 20. FIG. 6 includes certain elements from the preceding figures.

In FIG. 6, the rear face 23 includes two rectangular claddings 26, with a normally rectangular section and the front face 24 includes two rectangular claddings 26, with a normally rectangular section. The construction block 20 includes a symmetry on either side of the transverse median plane of the construction block 20.

Figure 7:
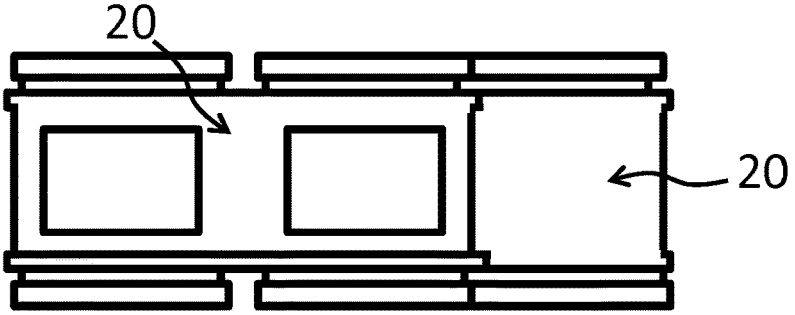

FIG. 7 shows a top view of the assembly of two construction blocks. FIG. 7 shows the assembly of a wall angle constituted by two construction blocks 20.

Figure 8:
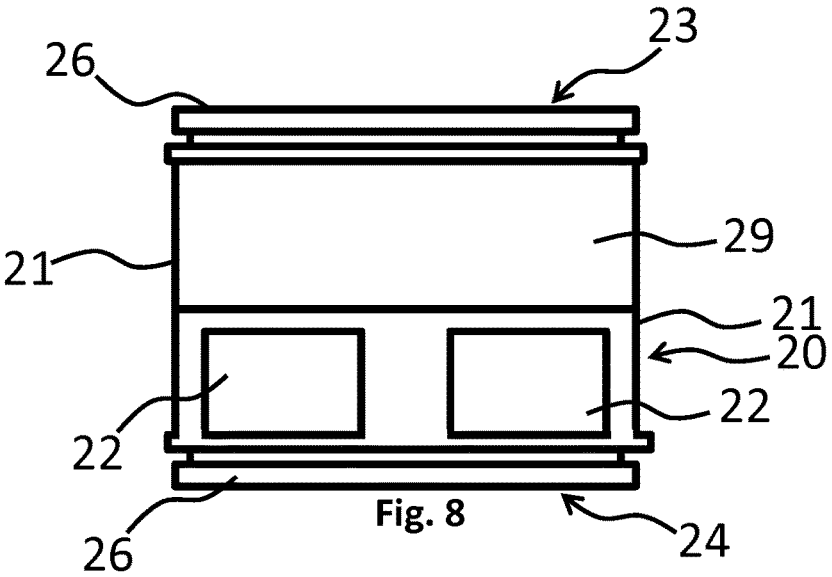

FIG. 8 shows a top view of another example of a construction block 20. FIG. 8 includes certain elements from the preceding figures.

The rear face 23 includes a rectangular cladding 26, the front face 24 includes a rectangular cladding 26.

Between the rear face 23 and the front face 24 is an insulation portion 29 and a second portion constituted by the two vertical openings 22. The width of the construction block 20 has increased.

The insulation portion 29 extends over the width of the construction block 20. The width is defined between the front face 24 and the rear face 23. The height is defined between the upper face 25 and the lower face. The length is defined between the two lateral faces.

Figure 9:
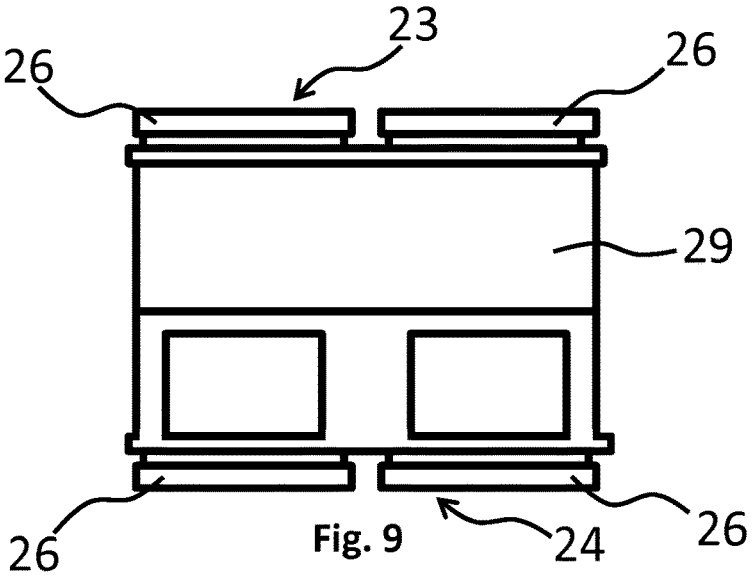

FIG. 9 shows a top view of another example of a construction block 20. FIG. 9 includes certain elements of the preceding figure.

In FIG. 9, the rear face 23 includes two rectangular claddings 26, with a normally rectangular section and the front face 24 includes two rectangular claddings 26, with a normally rectangular section.

Figure 10:
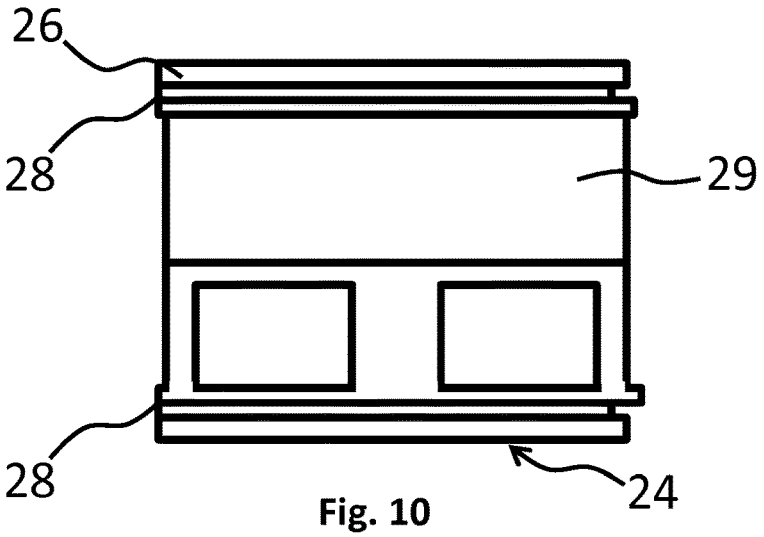

FIG. 10 shows a top view of another example of a construction block 20. FIG. 10 includes certain elements of FIGS. 8 and 9.

In FIG. 10, one of the lateral faces includes two substantial beads 28 (the one on the left in the figure), i.e. it is wider than the other lateral face. The gap of the cladding 26 adjacent to said lateral face does not exist.

The width of the bead 28 is constituted by the thickness of the cladding 26, of the gap of the cladding 26 and of a portion of the width of a lateral face.

Figure 11:
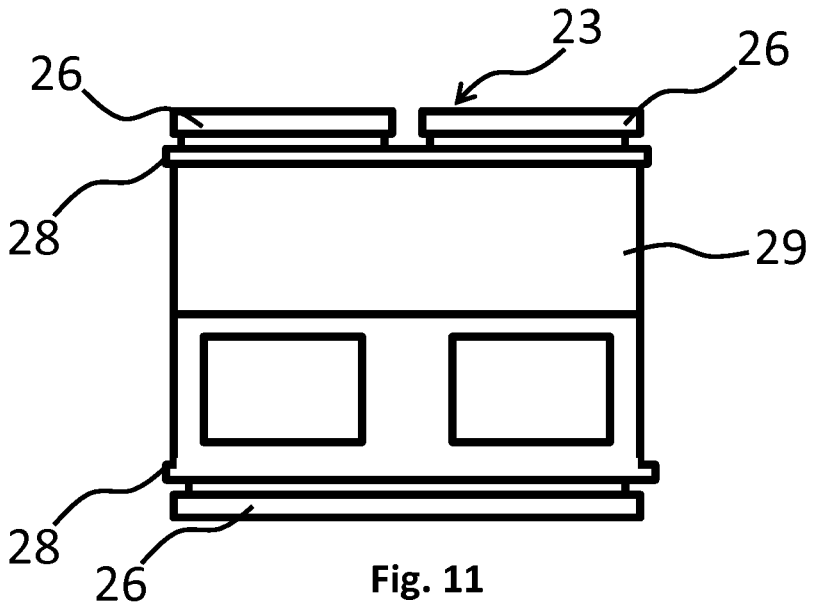

FIG. 11 shows a top view of another example of a construction block 20. FIG. 11 includes certain elements of FIGS. 8 to 10.

In FIG. 11, the rear face 23 includes two rectangular claddings 26, with a normally rectangular section and the front face 24 includes a rectangular cladding 26, with a normally rectangular section.

Figure 12:
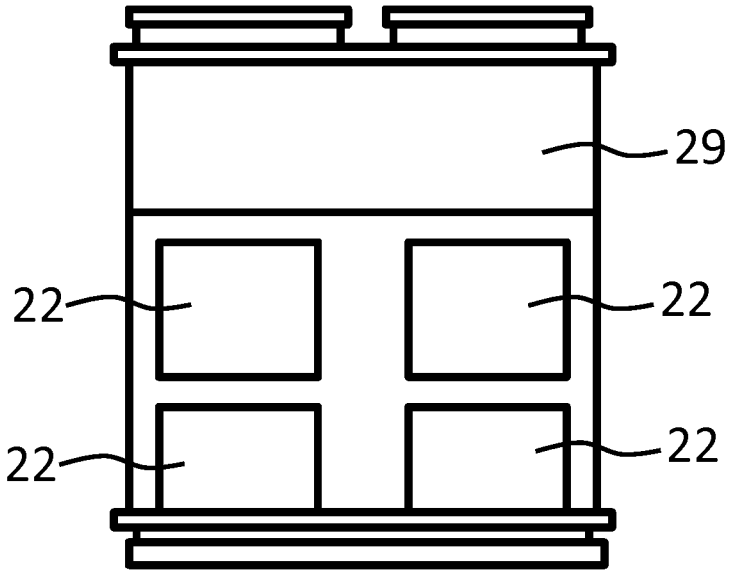

FIG. 12 shows a top view of another example of a construction block 20. FIG. 12 includes certain elements of FIGS. 8 to 11.

In FIG. 12, the construction block 20 includes four vertical openings 22. The four vertical openings 22 are rectangular and disposed symmetrically on either side of the transverse median plane of the construction block 20. According to an alternative embodiment, two of the four vertical openings 22 include insulation.

In an example not shown, the gap between two claddings 26 makes it possible to position a rail which will include for example wires for electricity, antenna, internet, etc. Power sockets are then positioned where desired on the rail and connected to the electrical wire of the rail.

NOMENCLATURE

20 construction block
21 recess
22 vertical opening
23 rear face
24 front face
25 upper face
26 cladding
27 shadow gap
28 bead
29 insulation

The invention claimed is:

1. A construction block of substantially parallelepiped shape, the construction block consisting essentially of:

an upper face configured to be associated with a lower face of one or two other similar construction blocks;

a lower face configured to associated with an upper face of the one or two similar construction blocks;

at least two vertical openings;

a front face;

a rear face;

two lateral faces located between distal ends of the front face and the rear face, each lateral face including a recess defined by two beads located at opposing sides of the two lateral faces;

the construction block being composed of expanding foam and sand; and an insulation portion, positioned between the rear face and the front face, extending over a width of the construction block, the insulation portion having a substantially parallelepiped shape, and a height and a length of the insulation portion is identical to the construction block, wherein the rear face or the front face comprises two rectangular claddings positioned thereon, with a normally rectangular section and between the two rectangular claddings is a shadow gap.

2. The construction block of claim 1, wherein a quantity of the expanding foam is between 0.5% to 15% by weight in sand.

3. The construction block of claim 2, wherein the quantity of the expanding foam is between 2% to 8% by weight in sand.

4. The construction block of claim 3, wherein the quantity of the expanding foam is between 3% and 6% by weight in sand.

* * * * *